US008505206B2

(12) United States Patent
VanHoy

(10) Patent No.: US 8,505,206 B2
(45) Date of Patent: Aug. 13, 2013

(54) FOLDING KNIFE WITH OPENING MECHANISM

(75) Inventor: Edward Tate VanHoy, Abingdon, VA (US)

(73) Assignee: GB II Corporation, Tualatin, OR (US)

( * ) Notice: Subject to any disclaimer, the term of this patent is extended or adjusted under 35 U.S.C. 154(b) by 781 days.

(21) Appl. No.: 12/429,051

(22) Filed: Apr. 23, 2009

(65) Prior Publication Data

US 2009/0271989 A1 Nov. 5, 2009

Related U.S. Application Data

(60) Provisional application No. 61/049,316, filed on Apr. 30, 2008, provisional application No. 61/128,846, filed on May 23, 2008.

(51) Int. Cl.
*B26B 3/06* (2006.01)

(52) U.S. Cl.
USPC ..... 30/159; 30/153; 30/158

(58) Field of Classification Search
USPC ..... 30/153, 155–161; 7/118, 129, 132, 7/158, 168, 128, 900
See application file for complete search history.

(56) References Cited

U.S. PATENT DOCUMENTS

| | | | | |
|---|---|---|---|---|
| 2,869,235 | A * | 1/1959 | Klenk | 30/252 |
| 4,604,803 | A * | 8/1986 | Sawby | 30/161 |
| 5,802,722 | A | 9/1998 | Maxey et al. | |
| 5,815,927 | A | 10/1998 | Collins | |
| 6,145,202 | A | 11/2000 | Onion | |
| 6,308,420 | B1 | 10/2001 | Moser | |
| 6,397,477 | B1 * | 6/2002 | Collins | 30/161 |
| 6,651,344 | B2 | 11/2003 | Cheng | |
| 6,834,432 | B1 | 12/2004 | Taylor, Jr. | |
| 7,051,441 | B2 | 5/2006 | Carter, III | |
| 7,086,157 | B2 | 8/2006 | Vallotton | |
| 7,107,686 | B2 * | 9/2006 | Linn et al. | 30/159 |
| 7,140,110 | B2 | 11/2006 | Lake | |
| 7,146,736 | B1 | 12/2006 | Collins | |
| 7,284,329 | B1 | 10/2007 | King | |
| 7,437,822 | B2 * | 10/2008 | Flagg et al. | 30/161 |
| 2004/0020058 | A1 * | 2/2004 | Vallotton | 30/160 |
| 2004/0244205 | A1 | 12/2004 | Linn et al. | |
| 2005/0223563 | A1 * | 10/2005 | VanHoy et al. | 30/161 |
| 2006/0064877 | A1 * | 3/2006 | Vallotton et al. | 30/153 |
| 2006/0174490 | A1 * | 8/2006 | Galyean et al. | 30/153 |

* cited by examiner

*Primary Examiner* — Kenneth E. Peterson
*Assistant Examiner* — Samuel A Davies
(74) *Attorney, Agent, or Firm* — Klarquist Sparkman, LLP

(57) ABSTRACT

In certain embodiments of the present disclosure, a folding knife has a biasing mechanism, such as a spring, that applies an opening force to the blade when the blade is in the closed, or folded, position (i.e., the force of the spring creates a moment in the opening direction of the blade). The folding knife includes a latching mechanism that holds the blade in a closed and latched position against the opening force of the spring. To open the blade, manual pressure is applied to the upper edge of the blade (the edge opposite the sharpened edge) to move the blade slightly to a closed and unlatched position to release the blade from being held from the latching mechanism whereupon the blade is then free to pivot under the opening force of the spring.

25 Claims, 10 Drawing Sheets

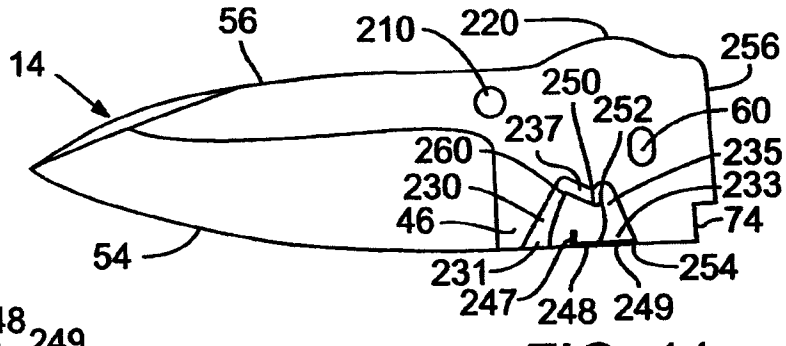
FIG. 11
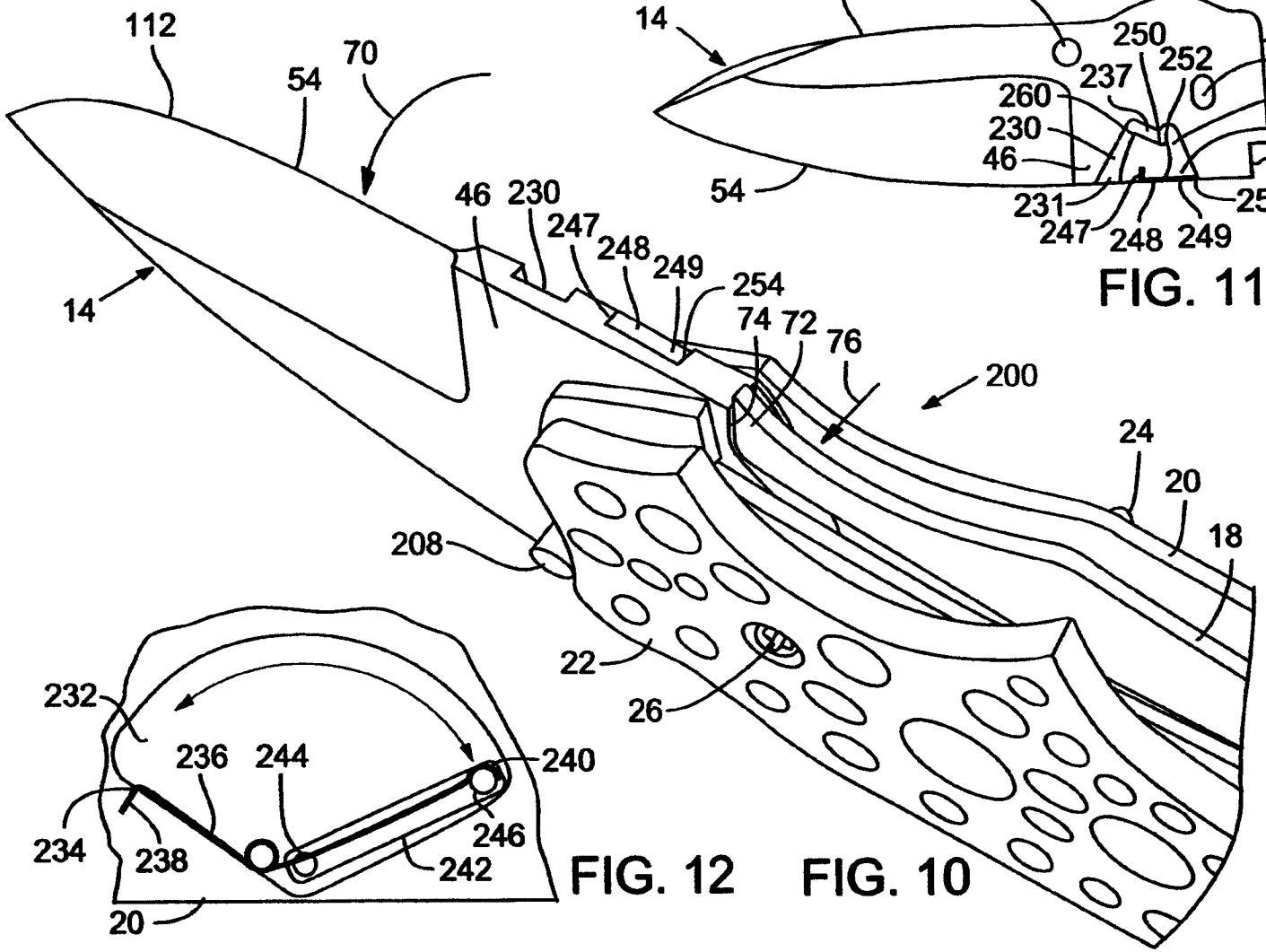
FIG. 10
FIG. 12

FOLDING KNIFE WITH OPENING MECHANISM

CROSS-REFERENCE TO RELATED APPLICATIONS

The present application claims the benefit of U.S. Provisional Application Nos. 61/049,316, filed Apr. 30, 2008 and 61/128,846, filed May 23, 2008, both of which applications are incorporated herein by reference.

FIELD

The present invention concerns embodiments of a folding knife.

BACKGROUND

An "assisted-opening" knife refers to a type of folding knife that uses a spring to deploy the blade upon application of manual pressure to the blade. Typically, the spring of an assisted opening knife is situated such that when the blade is in a closed position, the spring applies a closing force to the blade to retain it in the closed position. To open the blade, the user applies enough pressure to a thumb stud on the side of the blade to pivot the blade about 30 degrees from the closed position, after which the spring begins to apply an opening force to deploy the blade without further manual pressure. A drawback of the conventional assisted-opening knife is that it is sometimes difficult to open without inadvertently applying a significant amount of force to the blade in a lateral direction (perpendicular to the plane in which the blade pivots) via the thumb stud. The lateral force on the blade increases drag on the blade and reduces the speed with which it can be opened.

SUMMARY

In certain embodiments of the present disclosure, a folding knife has a biasing mechanism, such as a spring, that applies an opening force to the blade when the blade is in the closed, or folded, position (i.e., the force of the spring creates a moment in the opening direction of the blade). This is in contrast to the spring of a conventional assisted-opening knife, which applies a closing force to the blade when it is in the closed position. The folding knife, according to certain embodiments of the present disclosure, includes a latching mechanism that holds the blade in a closed and latched position against the opening force of the spring. To open the blade, manual pressure is applied to the upper edge of the blade (the edge opposite the sharpened edge) to move the blade slightly to a closed and unlatched position whereupon the blade is then free to pivot under the opening force of the spring. For example, the blade can be opened by holding the knife in the palm of the hand and applying a closing force against the upper edge of the blade (i.e., a force in a direction generally opposite the opening direction of the blade) such as by squeezing the blade using the thumb to unlatch the blade from the latching mechanism. Because the force moment of the spring is always acting in the opening direction of the blade, the spring immediately causes the blade to begin pivoting after the blade is moved a relatively small distance within the handle. Moreover, since the manual pressure required to move the blade to the unlatched position is applied to the upper edge of the blade, rather than the side of the blade, drag on the blade caused by a laterally directed force component can be minimized. Consequently, the blade can be opened in a more efficient manner and with greater blade speed than the above-described conventional assisted opening knife.

In a representative embodiment, a folding knife comprises a handle portion, a blade pivotably connected to the handle portion and having a bottom surface including a sharpened edge and an upper surface opposite the bottom surface. The blade is pivotable relative to the handle portion between a closed position and an open position wherein the sharpened edge is exposed for use. The knife further includes a biasing mechanism configured to exert a biasing force against the blade and a latching mechanism configured to hold the blade in the closed position against the biasing force of the biasing mechanism. Manual pressure applied to the upper surface of the blade is effective to release the blade from being held by the latching mechanism and therefore allow the biasing force to cause the blade to pivot from the closed position toward the open position.

In another representative embodiment, a folding knife comprises a handle portion and a blade pivotably connected to the handle portion. The blade has a bottom surface including a sharpened edge and an upper surface opposite the bottom surface. The blade is moveable from a closed and latched position to a closed and unlatched position. The blade is also pivotable relative to the handle portion from the closed and unlatched position to an open position in a plane defined by the upper surface and bottom surface of the blade. The knife also includes biasing means for exerting a biasing force against the blade and latching means for holding the blade in the closed and latched position against the biasing force of the biasing mechanism and for allowing the blade to pivot toward the open position under the biasing force when the blade is manually moved from the closed and latched position to the closed and unlatched position.

In another representative embodiment, a folding knife comprises a handle portion having a blade receiving space and a blade pivotably connected to the handle portion. The blade has a bottom surface including a sharpened edge and an upper surface opposite the bottom surface, the blade being moveable from a closed and latched position to a closed and unlatched position in a direction into the blade receiving space upon application of manual pressure to the upper surface of the blade. The blade is also pivotable out of the blade receiving space from the closed and unlatched position to an open position wherein the sharpened edge is exposed for use. The knife also includes a biasing mechanism configured to exert a biasing force against the blade and a latching mechanism comprising a slot and a pin. The slot is formed in one of the handle portion and the blade and the pin is secured to the other of the handle portion and the blade and extends laterally into the slot. The slot and the pin cooperate to hold the blade in the closed and latched position against the biasing force of the biasing mechanism and allow the blade to pivot outwardly from the closed position under the biasing force when the blade is moved to the closed and unlatched position by application of manual pressure to the upper surface of the blade. The slot also comprises a first slot portion and a second slot portion. The first slot portion is shaped to receive the pin when the blade is in the closed and latched position such that the pin engages a side of the slot and prevents opening of the blade under the biasing force. The second slot portion is shaped to receive the pin when the blade is moved to the closed and latched position and allow movement of the pin in the second portion of the slot, thereby allowing the blade to move toward the open position under the biasing force.

In another representative embodiment, a method of operating a folding knife comprises providing a folding knife comprising a handle portion, a blade pivotably connected to the handle portion and a biasing mechanism that exerts an opening force against the blade. The method further comprises applying a closing force to the blade, when the blade is in a closed and latched position, to displace the blade from the closed and latched position to a closed and unlatched position, thereby allowing the blade to pivot from closed and unlatched position toward an open position under the opening force of the biasing mechanism.

BRIEF DESCRIPTION OF THE DRAWINGS

FIG. 10 is an enlarged, partial perspective view of a folding knife, according to a second embodiment.

FIG. 11 is a side view of the blade of the folding knife of FIG. 10.

FIG. 12 is a side view of a portion of the latching mechanism of the folding knife of FIG. 10.

DETAILED DESCRIPTION

As used herein, the singular forms "a," "an," and "the" refer to one or more than one, unless the context clearly dictates otherwise.

As used herein, the term "includes" means "comprises." For example, a device that includes or comprises A and B contains A and B but may optionally contain C or other components other than A and B. A device that includes or comprises A or B may contain A or B or A and B, and optionally one or more other components such as C.

Figure 1:
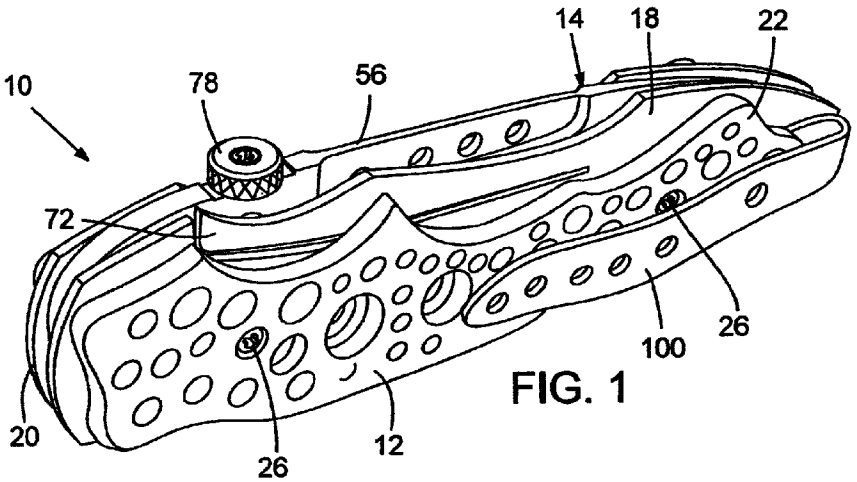
FIG. 1 is a perspective view of a folding knife, according to one embodiment.
Figure 2:
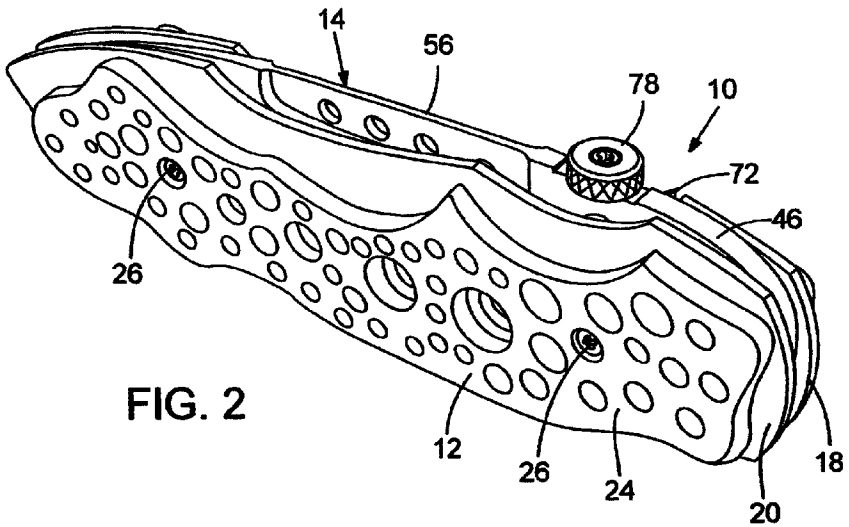
FIG. 2 is another perspective view of the folding knife of FIG. 1.
Figure 9:
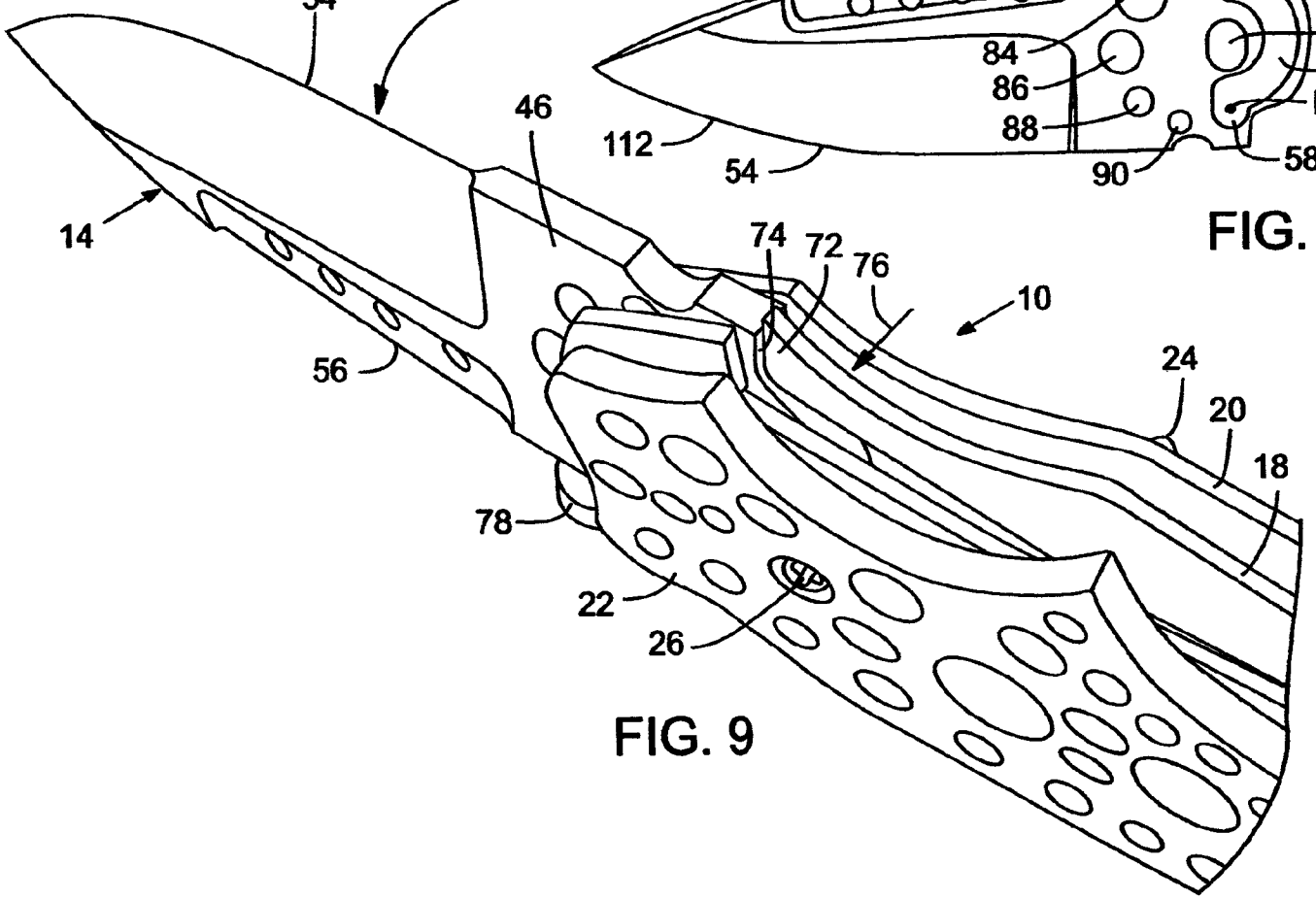
FIG. 9 is an enlarged, partial perspective view of the folding knife of FIG. 1 shown with the blade in the open position.

Referring first to FIGS. 1-7, there is shown a folding knife 10, according to one embodiment, that comprises a handle portion 12 and a knife blade 14. The knife blade 14 is pivotably connected to the handle portion 12 by a pivot mechanism 16 to permit pivoting of the blade between a closed, or folded position where the blade is at least partially stored in the handle portion (as shown in FIG. 1) and an open position for use of the blade (as shown in FIG. 9). The knife 10 can be provided with a clip 100 secured to the handle portion 12 so that the knife can be clipped onto a belt, a pocket, etc. The blade 14 has a "bottom" surface 54 that includes a sharpened edge 112 (referred to as the sharpened side or edge of the blade) and an "upper" surface 56 (referred to as the non-sharpened side or edge of the blade).

The handle portion 12 in the illustrated configuration comprises first and second inner liners, or panels, 18, 20, respectively, and first and second outer liners, or panels, 22, 24 (also referred to as "scales'), respectively. The outer liners 22, 24 can be secured to the inner liners 18, 20, respectively, by screws 26. The inner liners 18, 20 are laterally spaced from each other with a spacer element 48 positioned therebetween to define a storage slot or space for receiving the blade in the closed position. In other embodiments, the handle portion can be formed from only two laterally spaced side panels without any outer panels or scales. In yet other embodiments, the handle portion can have an open frame design where one side of the handle portion is open to expose one side of the blade.

Figure 6:
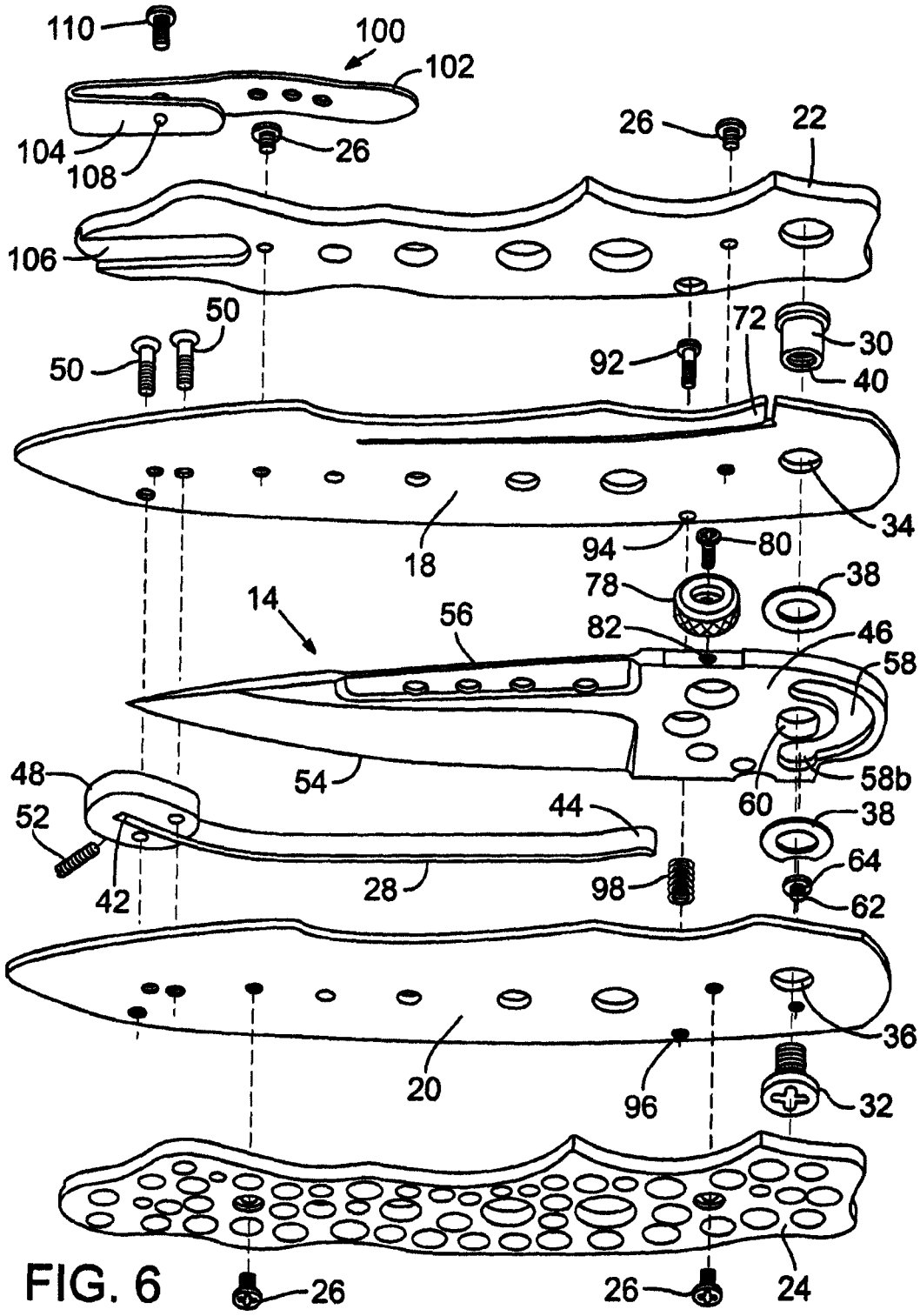
FIG. 6 is an exploded, perspective view of the folding knife of FIG. 1.

As best shown in FIG. 6, the inner plates 18, 20 can be secured to each other by screws 50 that extend through corresponding openings in the first inner plate 18 and the spacer element 48, and are tightened into corresponding threaded openings in the second inner plate 20. The blade 14 can be connected to the handle portion 14 by the pivot mechanism 16, which can comprise a pivot pin 30 and a pivot screw 32. The pivot pin 30 extends through openings 34, 36 in the inner plates 18, 20, an opening 60 in the tang 46 of the blade 14, and optionally through washers 38. The pivot screw 32 extends through opening 36 in the inner plate 20 and is tightened into a threaded opening 40 in the pivot pin 30.

The knife 10 can also include a locking mechanism to hold the blade in the open position and protect against inadvertent closing of the blade. Various locking mechanisms are known in the art and can be incorporated into the knife 10. The knife 10 in the illustrated configuration has a locking mechanism in the form of a spring arm 72 integrally formed in the inner plate 18. Referring to FIG. 9, the spring arm 72 operates the same as a conventional liner lock. The spring arm 72 is biased laterally toward the blade so that when the blade is in the open position, the spring 72 moves into a position behind and contacting a rear surface 74 of the blade tang 46 as shown in FIG. 9 to resist closing of the blade. The spring arm 72 can be disengaged from the blade by manually moving the spring arm 72 laterally away from the blade in the direction of arrow 76. When the spring arm 72 is clear of the rear surface 74 of the blade, the blade can be pivoted closed.

The knife 10 also includes a biasing mechanism configured to exert a biasing force against the blade that is sufficient to pivot the blade from the closed position to the open position when the blade is released from a latching mechanism. The knife is further configured to release the blade from the latching mechanism when manual pressure is applied to the non-sharpened (upper) edge 56 of blade. Accordingly, the application of manual pressure to the non-sharpened edge of the blade is effective to move the blade to an unlatched position, at which point the biasing force against the blade causes the blade to pivot from the closed position to the open position.

In the illustrated embodiment, for example, the knife includes a biasing mechanism in the form of a leaf spring 28. The leaf spring 28 includes a fixed end portion 42 that is fixed relative to the handle portion and a free end portion 44 that bears against the bottom edge 54 of the blade. The fixed end portion 42 can be held in the spacer element 48 to hold the fixed end portion 42 at a fixed location relative to the handle portion. A set screw 52 can be provided to assist in retaining the fixed end portion in the spacer element. The set screw 52 extends through the spacer element and is tightened against the fixed end portion 42. Desirably, the leaf spring 28 is selected to provide a biasing force against the blade that is sufficient to pivot the blade open from the closed position after it is released from its locked position. In other embodiments, the leaf spring provides a biasing force to move the blade toward the open position but the biasing force alone may not completely open the blade (e.g., the spring causes the blade to pivot between 30 and 160 degrees from the closed position). In such embodiments, manual force applied to the blade or a flicking motion of the wrist may be used to further pivot the blade to the fully open position once the blade is released from the latching mechanism.

Other types of biasing mechanisms can be used to apply an opening force to the blade, including, without limitation, a torsion spring, a bent wire spring, or a spring-biased plunger. Moreover, the biasing mechanism need not directly contact the blade. For example, the free end of the leaf spring can be positioned to contact a cam member connected to the side of the blade, yet is still effective to exert a biasing force against the blade.

Figure 7:
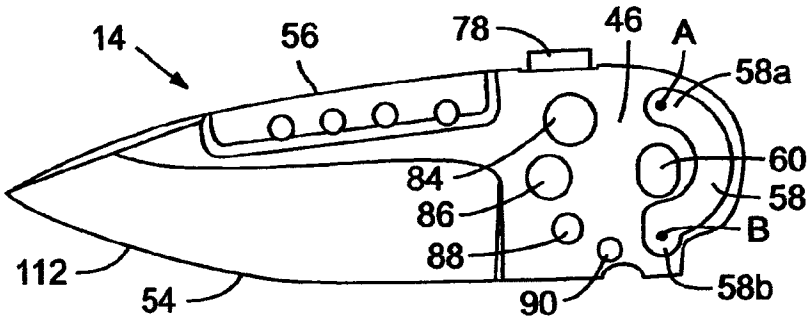
FIG. 7 is a side view of the blade of the folding knife of FIG. 1.
Figure 8A:
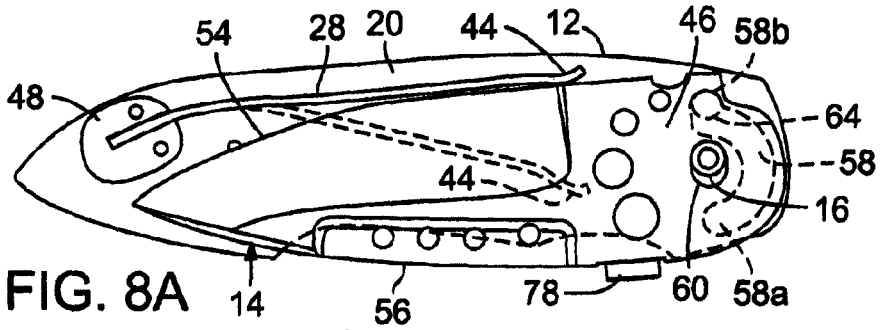
FIGS. 8A-8D are side views illustrating the operation of the folding knife of FIG. 1.

As best shown in FIG. 7, the opening 60 in the blade tang through which the pivot mechanism extends is elongated in a direction that is perpendicular to the length of the blade (i.e., in a direction extending from the top edge to the bottom edge of the blade). The opening 60 is sized to permit displacement of the blade relative to the pivot mechanism 16 in order to release the blade from the latching mechanism, as described in greater detail below. The blade tang 46 further includes an arcuate channel or slot 58 that receives a guide pin, or stud, 62. Referring to FIGS. 6 and 8A, the guide pin 62 is fixedly secured to the inner plate 20 and has a head portion 64 that extends into the slot 58. The slot 58 includes a first arcuate portion 58*a* that extends approximately 180 degrees around the opening 60 and a straight end portion 58*b* that extends in a direction toward the bottom edge 54 of the blade. The angular distance traveled by the blade relative to the guide pin 62 when the blade is pivoted from the closed position to the open position is the angle between points A and B, which represent the center of the guide pin when the blade is open and closed, respectively. In the illustrated embodiment, the blade pivots through approximately a 170-degree angle relative to the guide pin 62 between points A and B when the blade is pivoted opened.

The slot 58 and the pin 62 in the illustrated example cooperate to function as the latching mechanism to hold the blade in the closed position against the biasing force of the spring 28. The slot and the pin also cooperate to allow the blade to open under the biasing force of the spring when the blade is manually moved to an unlatched position, and to limit further pivoting of the blade in the opening direction when the blade reaches the open position.

Figure 8B:
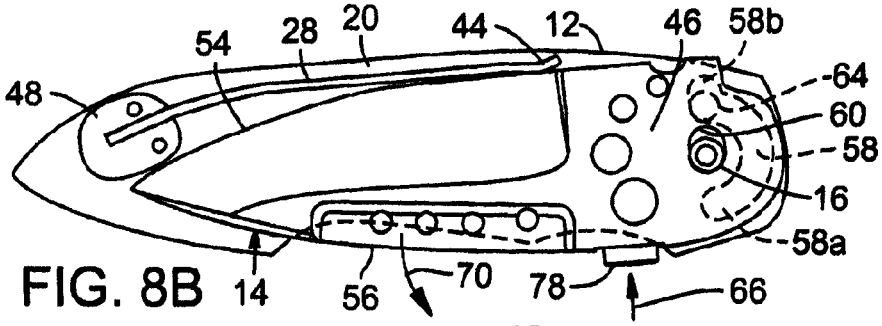

Referring to FIGS. 8A-8D, the operation of the illustrated knife 10 will now be described. FIG. 8A shows the knife with the blade 14 being held in the closed and latched position. In this position, the head 64 of pin 62 is at least partially located in the end section 58*b* of slot 58, and the biasing force of the spring acting against the blade (in a generally counter-clockwise direction in FIG. 8A) urges the blade against the pin so as to retain the blade in the closed and latched position. Referring to FIG. 8B, to open the blade, the blade is first manually moved to a closed and unlatched position where the blade is released from being held by the pin by applying a manual force against the non-sharpened edge 56 in the direction of arrow 66 to move the head 64 of the pin out of the end section 58*b* of the slot 58. Because, as noted above, the blade opening 60 that receives the pivot mechanism 16 is elongated, manual pressure applied to the blade allows the blade to be displaced in the direction of arrow 66 relative to the pivot mechanism 16 and the pin 62. The application of manual pressure to the non-sharpened edge 56 can be described as applying a closing force to the blade because the direction of the force is generally opposite the opening direction of the blade. Also, movement of the blade to the closed and unlatched position causes the blade to move further into the blade-receiving space between liners 18, 20 toward the back edge of the handle 12.

Figure 8C:
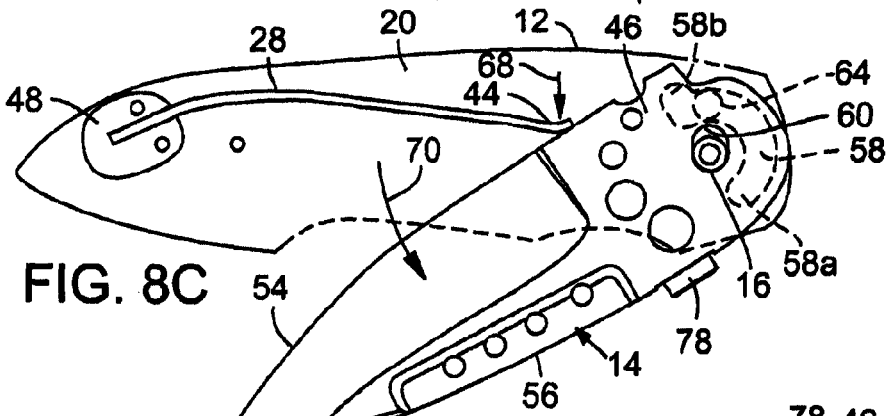
Figure 8D:
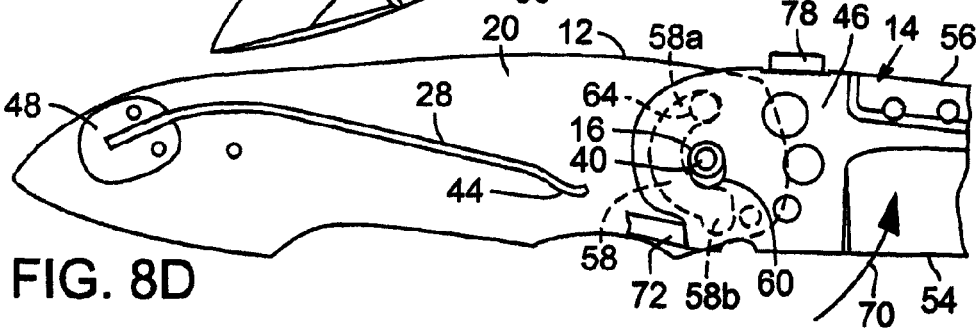

Referring to FIGS. 8B and 8C, when the head 64 of the pin is moved out of the end section 58*b* of the slot and the manual pressure is removed from the blade, the biasing force of the spring 28 against the blade (represented by arrow 68) causes the blade 14 to pivot toward the open position (in the counter-clockwise direction in the figures as indicated by arrows 70). As discussed above, the spring 28 desirably is selected to apply a force sufficient to pivot the blade from the closed and unlatched position (FIG. 8B) to the fully open position (FIG. 8D) without any manual force applied to the blade in the opening direction. As shown in FIG. 8D, the head 64 of the pin 62 engages the end of the slot 58 opposite slot section 58*b* when the blade reaches the open position to prevent further pivoting of the blade in the opening direction. As noted above, the knife can include a locking mechanism in the form of spring arm 72 (FIG. 9) to protect against inadvertent closing of the blade.

As used herein, "displacement" of the blade means movement of the blade that is not pure rotation about its pivot axis. For example, displacement of the blade can be translational movement of the blade along a straight path without any rotation or movement that includes translational movement and rotational movement.

To close the blade, the spring arm 72 is disengaged from the back of the blade and the blade is manually pivoted to the closed position against the biasing force of the spring 28. When the blade reaches the closed position and unlatched position (FIG. 8B), the spring 28 urges the blade to move to the closed and latched position wherein the head 64 of the pin 62 resides at least partially within the slot section 58*b* (FIG. 8A).

To facilitate opening of the blade, a thumb stud, or thumb pad, 78 can be mounted to the non-sharpened edge 56 of the blade. As best shown in FIG. 6, the thumb stud can be secured to blade by a screw 80 that extends through the stud and is tightened into a threaded opening 82 in the edge of the blade. The thumb stud 78 desirably is positioned along the blade at a location where pressure manual applied in a direction perpendicular to the surface of the thumb stud (arrow 66 in FIG. 8B) displaces the blade relative to the pivot 16 and the guide pin 62. In the illustrated embodiment, the thumb stud 78 is positioned along upper surface 56 at a location intermediate the free end 44 of the spring and the pivot 16, and desirably is positioned approximately equidistant from the free end 44 of the spring and the pivot 16. Due to the shape of the opening 60 and the shape of the slot 58 and its position relative to opening 60, manual pressure applied along the non-sharpened side 56 between the thumb stud 78 and the tip of the blade is less likely to shift the blade relative to the pivot 16 to the unlatched position. In other words, the opening 60, the slot 58, the guide pin 62 and the spring 28 cooperate to retain the blade in the latched position until manual pressure is applied in the area of the thumb stud to minimize inadvertent opening of the blade. In alternative embodiments, the slot 58, the opening 60, and the guide pin 62 can be configured to permit unlatching of the blade if manual pressure is applied at any location along the non-sharpening side 56 of the blade. To ensure further locking of the blade, the knife can include a safety mechanism, such as a sliding latch or blocking element, that is moveable to a blocking position in the path of the blade to restrict movement of the blade from the closed position even if sufficient manual pressure is applied to the thumb stud to shift the blade to the unlatched position shown in FIG. 8B.

In an alternative embodiment, the thumb stud 78 can have a spherical or cylindrical contact surface and can be made of a low-friction material, such as Teflon, Delron, or high density polyethylene, to reduce friction between the thumb stud and the user's thumb. The thumb stud can also be in the form of a rotating bearing having a cylindrical contact surface. When thumb pressure is applied to the bearing, it transfers the thumb pressure to the blade to shift the blade to the unlatched position and then directs the user's thumb in a direction away from the blade so as to reduce drag on the blade acting against the force of the spring 28.

In another embodiment, the position of the slot 58 and the guide pin 62 can be reversed. That is, the slot 58 can be formed in the handle portion (such as in one of the liners 18, 20) and the guide pin 62 can be secured to the side of the blade tang 46 and extend laterally into the slot 58. In such an embodiment, the knife functions the same as described above and shown in FIGS. 8A-8D.

As shown in FIG. 7, the blade 14 can include weight reducing holes 84, 86, 88, 90 angularly spaced around the pivot axis of the blade to reduce the overall weight of the blade and to reduce surface drag or friction between the flat sides of the blade and the inner surfaces of panels 18, 20, which in turn increases the speed with which the blade can be opened by the spring. The diameters of the holes can gradually decrease from the largest hole 84 adjacent the non-sharpened edge 56 of the blade to the smallest hole 90 adjacent the sharpened edge 54 of the blade so that less mass is removed proximate the sharpened edge of the blade where the spring force is applied than proximate the non-sharpened edge of the blade. This balances the weight of the blade relative to the blade pivot axis so as to minimize sliding friction between the blade and the inner panels when the blade is pivoted to the open position.

The knife 10 can also include an adjustment mechanism that is configured to adjust (increase or decrease) the compression force of the inner panels 18, 20 on the blade, which in turn varies the drag of the blade. For example, as best shown in FIG. 6, the adjustment mechanism can comprise a screw 92 that extends through a hole 94 in the first inner panel 18 and is tightened into a threaded hole 96 in the second inner panel 20. A coil spring 98 is disposed on the screw between the panels 18, 20. The spring 98 is placed in compression with its opposite ends bearing against the inner surfaces of the panels 18, 20. The spring 98 applies a separating force to the inner surfaces of the panels 18, 20 to maintain a minimum lateral spacing between the panels proximate the blade tang 46. Tightening the screw 92 (against the spring) decreases the spacing between the panels 18, 20 and increases the compression force applied to the blade by the inner panels 18, 20, which in turn increases friction on the sides of the blade and reduces the speed with which the blade can be opened. Conversely, loosening the screw 92 increases the spacing between the panels 18, 20 and decreases the compression force applied to the blade by the inner panels 18, 20, which in turn decreases friction on the sides of the blade and increases the speed with which the blade can be opened.

Figure 3:
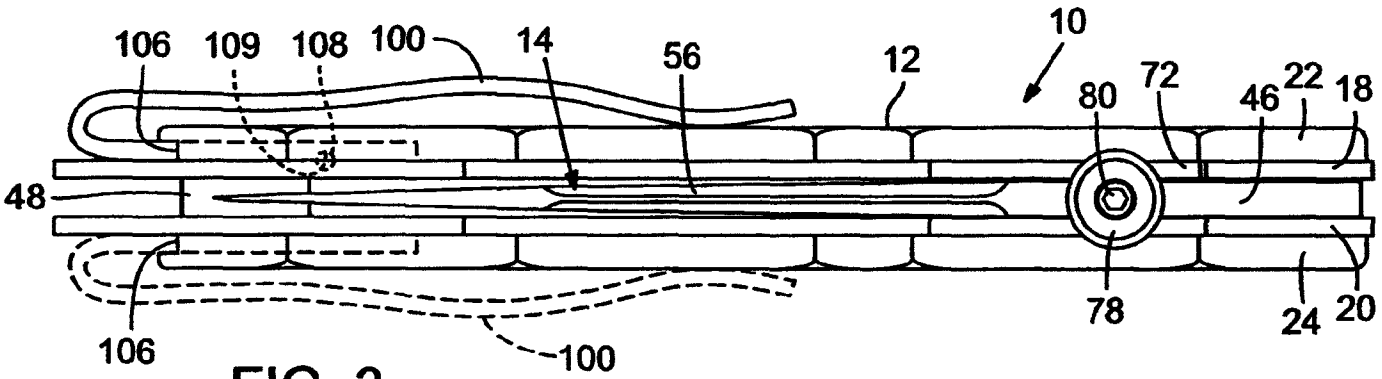
FIG. 3 is a bottom plan view of the folding knife of FIG. 1.
Figure 4:
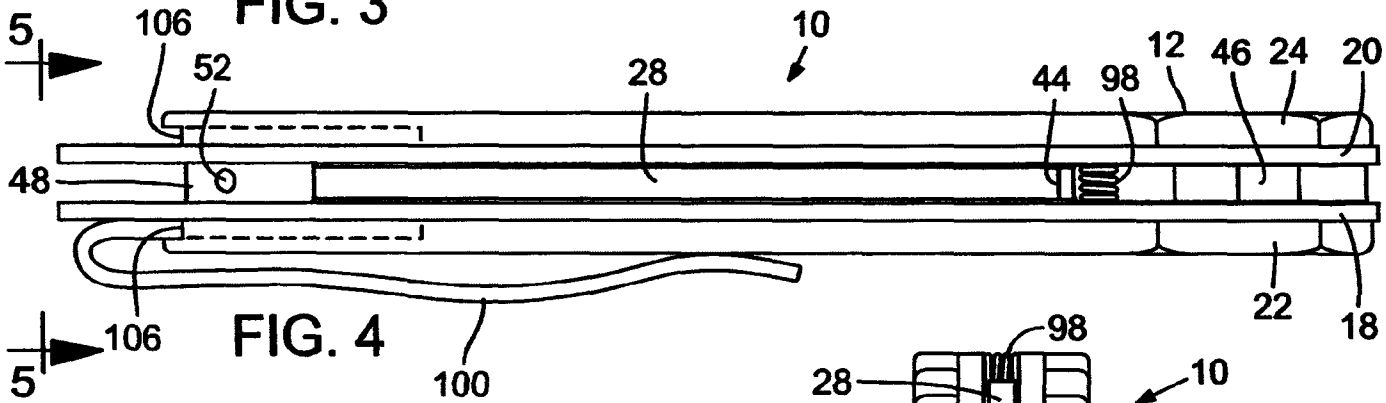
FIG. 4 is a top plan view of the folding knife of FIG. 1.
Figure 5:
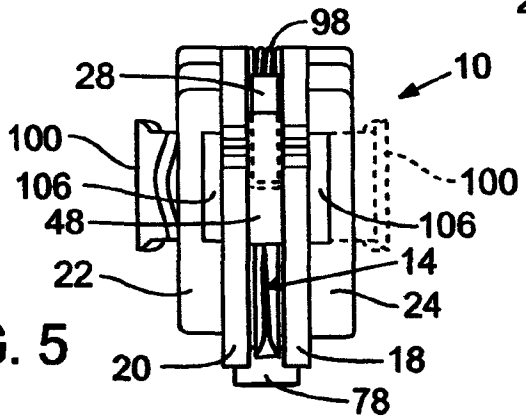
FIG. 5 is an elevation view of the rear end of the folding knife of FIG. 1.

The clip 100 desirably is configured to be reversible; that is, the clip can be mounted on and removed from either side of the handle portion 12. For example, as best shown in FIG. 6, the clip 100 can include first leg portion 102 and a second, shorter leg portion 104, which can be formed by bending the clip. Referring to FIGS. 5 and 6, the end of each outer panel 22, 24 can be formed with an opening or slot 106 sized to receive the second leg portion 104 of the clip. To assist in retaining the clip 100 in either slot 106, the leg portion 104 can include a ball 108 projecting from a lower surface thereof. Each inner panel 18, 20 can be formed with a corresponding concave detent (not shown) positioned opposite each slot 106. Thus, when the leg portion 104 is fully inserted into a slot 106, the ball 108 is received in a corresponding detent in the surface of a panel 18, 20 to assist in retaining the clip in place. In this manner, the clip need not include any screws or other fasteners that require the use of a tool to secure the clip to the handle portion. A user therefore can easily remove the clip from one slot 106 and insert it into the other slot on the opposite side of the knife without the use of tools. In alternative embodiments the leg portion 104 can be formed with a detent and either outer panels 22, 24 or inner panels 18, 20 can include balls that are positioned to project into the detent when the leg portion 104 is inserted into a slot 106. For example, as shown in FIG. 3, a ball 108 can be held securely on inner panel 18 (e.g., the ball 108 can be held in an opening in inner panel 18) and can be positioned to project into a detent 109 on leg portion 104 when leg portion 104 is inserted into slot 106. In lieu of or in addition to the ball-and-detent retaining mechanism described above, a screw 110 (FIG. 6) optionally can be used to secure the clip 100 to the handle portion 12.

Moreover, the openings 106 are located proximate the rear end of the handle portion 12 (the end opposite the pivot 16) so as to secure the clip 100 proximate the rear end of the handle portion. Thus, when the knife is clipped inside a pocket, the user can remove the knife from the pocket and immediately open the blade without much repositioning of the knife in the hand.

FIGS. 10-15 illustrate another embodiment of a folding knife, indicated generally at 200. As shown, the knife 200 can have many of the same components of the knife shown in FIGS. 1-9. Thus, components in FIGS. 10-15 that are identical to corresponding components in FIGS. 1-9 have the same respective reference numerals and are not described further.

Figure 14A:
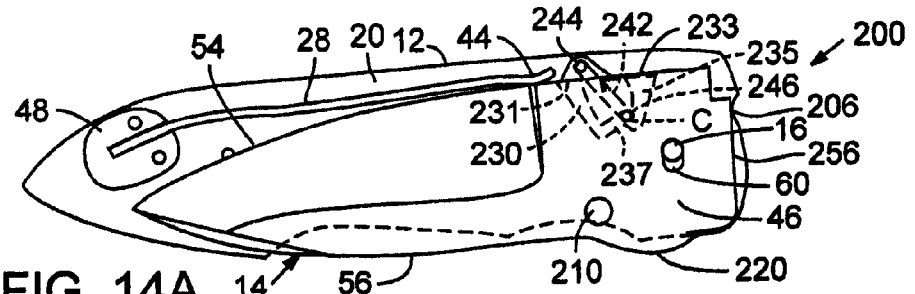
FIGS. 14A-14D are side views illustrating the operation of the folding knife of FIG. 10.

As shown in FIG. 11, the upper surface 56 of the blade 14 has a raised portion 220 at the tang 46. As shown in FIG. 14A, the raised portion 220 extends beyond the adjacent surfaces of the inner plates 18, 20 such that it can be pressed upon by a user to unlatch the blade, as described in detail below.

Figure 13:
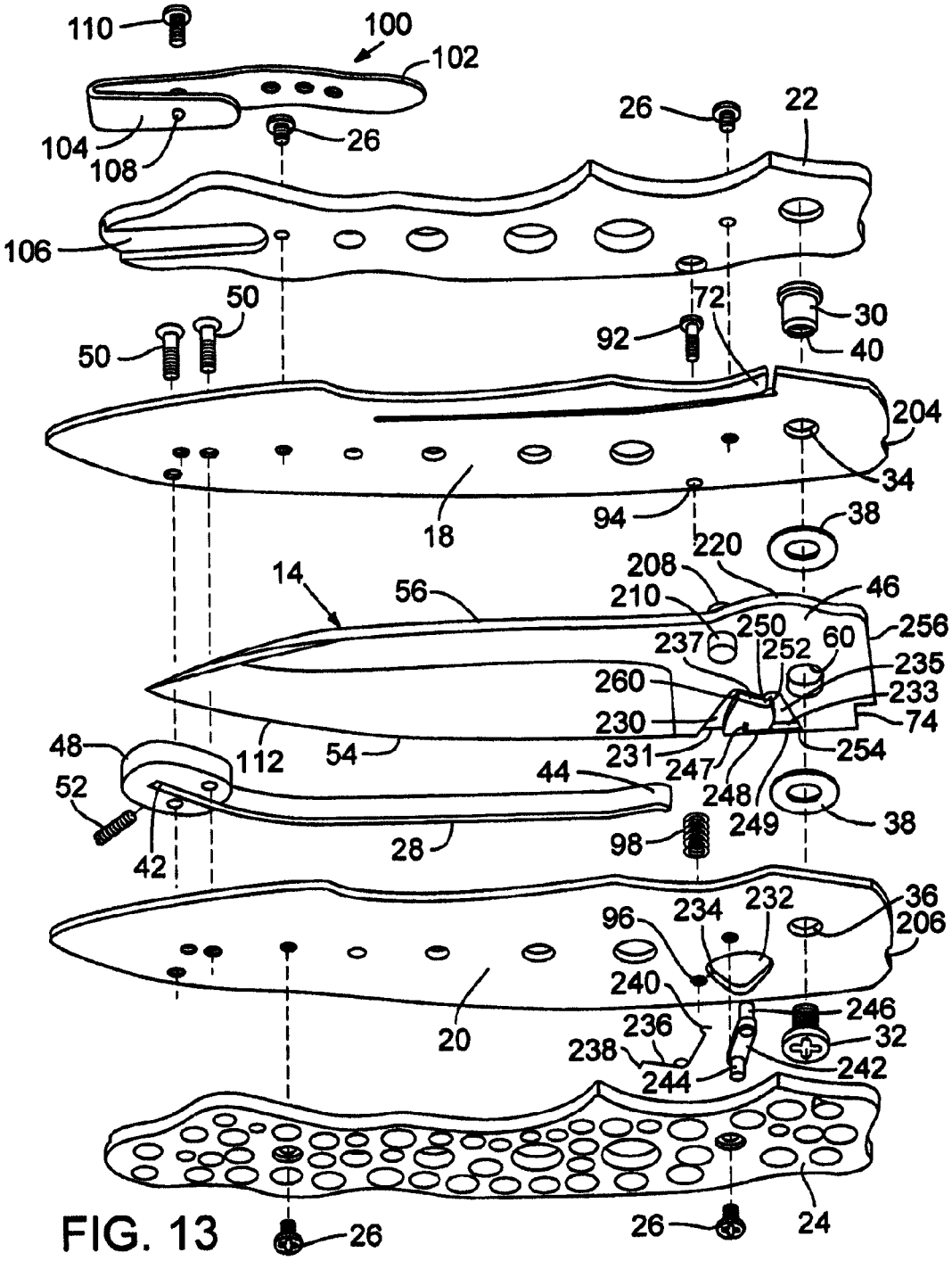
FIG. 13 is an exploded, perspective view of the folding knife of FIG. 10.

First and second stopping pegs, or studs, 208, 210, respectively, can be attached to each side of the blade tang 46, as shown in FIG. 13. The first and second stopping pegs can be located near the upper surface 56 such that they extend laterally over the first and second inner plates 18, 20, respectively when the knife is in the closed position. When the blade is extended to the open position, as shown in FIG. 14D, the first and second stopping pegs abut first and second concave notches 204, 206, respectively, located on the front surface of each of the inner liners 18, 20, respectively, to prevent the blade from rotating beyond the open position. In alternative embodiments, the stopping pegs can be formed as part of the blade itself rather than from separately attached parts, or they can be formed from a single longer peg that extends through and beyond a corresponding hole in the blade 14. Moreover, in other embodiments, only one stopping peg is used.

The knife 200 has a latching mechanism comprising a channel 230 formed in the blade and a pivoting lever arm 242, which cooperate to hold the blade in the closed position against the biasing force of the leaf spring 28. The channel 230 and the lever arm 242 also cooperate to allow the blade to open under the biasing force of the spring when the blade is manually moved to an unlatched position.

As best shown in FIG. 13, the recessed channel 230 can be formed on the side surface of the blade tang 46 that is adjacent to the second inner plate 20. The channel extends from an opening 231 on the bottom surface 54 of the blade tang to another opening 233 on the bottom surface 54 nearer to the rear surface 74 of the blade in a generally "M"-shaped configuration. The purpose of this shape is discussed below. An optional spring plate, or gate, 248 can be attached to the bottom surface of the blade tang 46 at a location between the two ends of the channel 230. The gate 248 has a fixed end portion 247 that is secured to the bottom of the blade tang and a free end portion 249 that extends over the opening 233 of the channel 230. For example, the fixed end portion 247 can be a bent end portion of the gate 248 that extends into an opening in the bottom surface of the tang between the two openings 231, 233 of the channel 230. In the operation of the knife 200, this spring plate 248 acts as a one-way gate during the relative travel of a guide pin 246 along the bottom surface of the blade such that the spring plate prevents the guide pin from re-entering that portion of the recessed channel, as explained in greater detail below.

An opening 232 can be formed in the second inner plate 20 at a location such that, when the blade is in the closed position, the opening 232 overlaps the portion of the blade tang with the recessed channel 230. The opening can be roughly the shape of a ninety-degree wedge with the rounded, circumferential portion closer to the upper surface 56 of the blade and the angular portion closer to the bottom surface 54 of the blade. The opening can alternatively be formed in any other shape that allows the knife 200 to function as hereinafter described.

The lever 242 can be positioned within the opening 232 in the second inner plate 20. One end of the lever is situated at the portion of the opening nearest to the bottom surface of the blade and is attached to a pivot pin 244. The other end of the lever 242 arcs about the rounded portion of the opening and is attached to the guide pin 246. The pivot pin 244 extends perpendicularly from the lever in a direction toward the second outer liner 24 and is secured at a fixed location relative to the outer liner 24. For example, the pivot pin 244 can be received in a cavity in the second outer liner such that the lever can pivot within the opening 232 about the pivot pin 244. Alternatively, the pivot pin can be formed as a portion of the outer plate that extends toward and into an opening in the end of the lever. The guide pin 246 extends perpendicularly from the other end of the lever toward the blade. When the blade is in the closed position, the guide pin extends into the recessed channel 230.

As best shown in FIG. 12, a wire spring 236 can be disposed in the opening 232 and positioned to bias the lever 242 and the guide pin 246 towards the portion of the opening closest to the forward notch 206. As shown, the wire spring can have two arms and a center coil. A fixed end portion 238 of one arm can be bent at an angle and can extend into a cavity 234 on the inner surface of the opening nearer to the threaded hole 96. A non-fixed end portion 240 of the other arm of the wire spring can have an arcuate bend extending around and bearing against the guide pin 246. The combined effect of the lever and the wire spring combined within the opening is to continually and resiliently bias the guide pin toward the portion of the opening nearest to the forward notch 206. In alternative embodiments, the wire spring 236 can be replaced with other conventional types of biasing mechanisms that produce the same biasing effect, such as a helical spring, a torsion spring or a bent wire spring without a coiled portion. Furthermore, the fixed end portion 238 of the spring can be attached to the second inner plate 20 at a point other than the cavity 234 or to the second outer liner 24. Also, the non-fixed end portion 240 of the spring can bear against the lever 242 rather than the guide pin itself to bias the lever and the guide pin towards the portion of the opening 232 closest to the notch 206.

Referring to FIGS. 14A-14D and FIGS. 15A-15E, the operation of the illustrated knife 200 will now be described. FIG. 14A shows the knife 200 with the blade 14 being held in a closed and latched position. In this position, the guide pin 246 is held at a stable position C within the recessed channel 230 of the blade tang 46. The biasing force of the leaf spring 28 acting against the blade (in a generally counter-clockwise direction in FIG. 14A) urges the blade to a latched position where the guide pin 246 is held in a concave notch 250 of the channel 230 so as to hold the blade against rotation about the pivot mechanism 16.

Figure 14B:
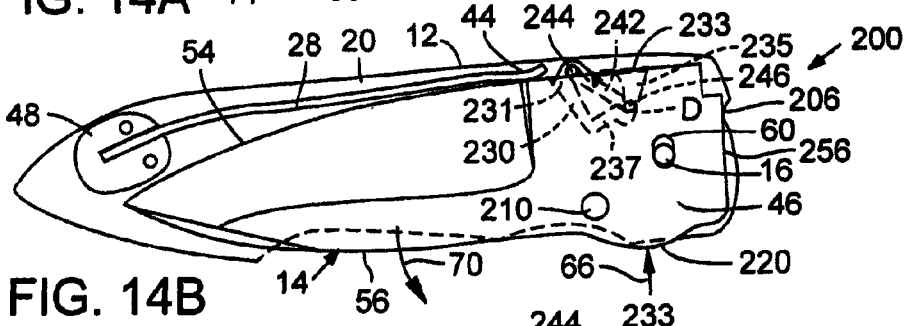
Figure 15A:
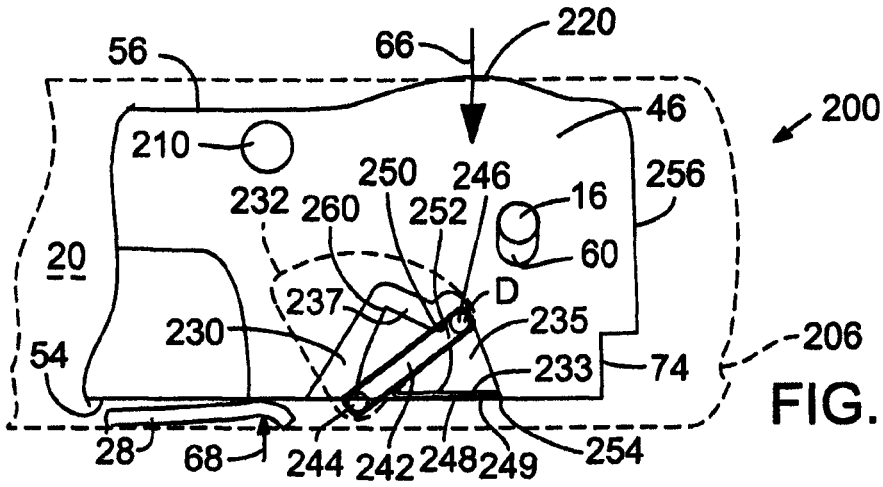
FIGS. 15A-15E are additional side views illustrating the operation of the folding knife of FIG. 10.
Figure 15B:
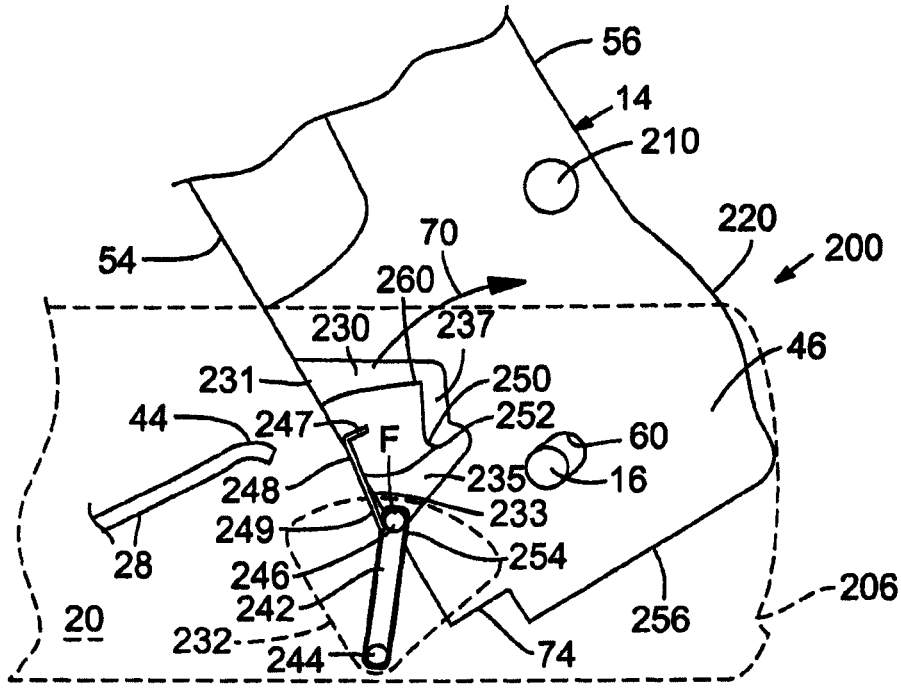
Figure 15C:
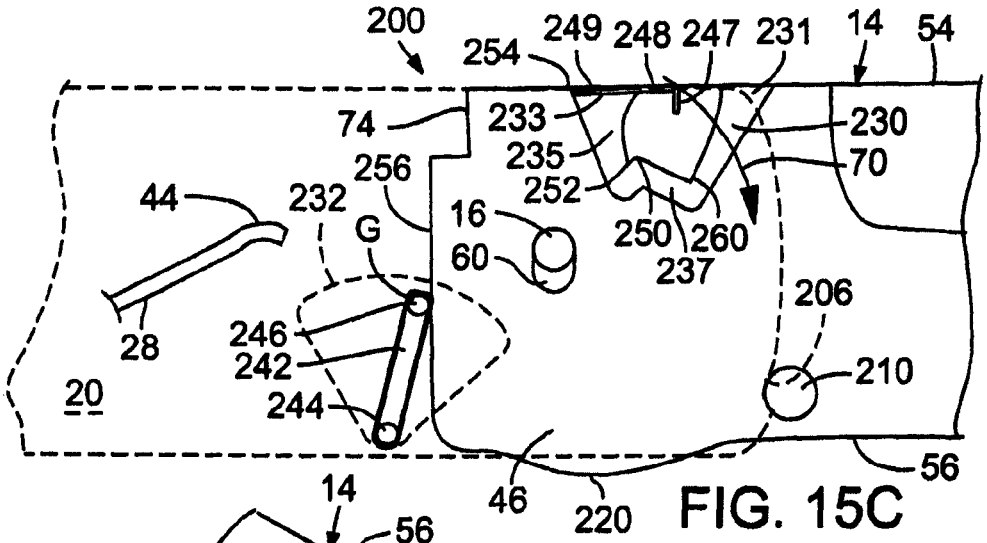

Referring to FIG. 14B, to open the blade, the blade is first manually moved to a closed and unlatched position by pressing on the raised portion 220 of the blade tang 46 in a direction toward the pivot mechanism 16 (illustrated by arrow 66). Because the opening 60 is elongate, the blade is allowed to move transversely a small distance relative to the pivot mechanism 16 in the direction of the applied manual force. During this movement, the guide pin 246, urged by the wire spring 236 and guided by the shape of the recessed channel 230, travels away from position C and around a lip 252 of the channel to position D in an elongate section 235 of the channel 230 (as best shown in FIG. 15A). The shape of this portion of the channel is such that the guide pin does not resist the force of the leaf spring 28 and the blade is free to begin rotating about the pivot mechanism 16.

Figure 14C:
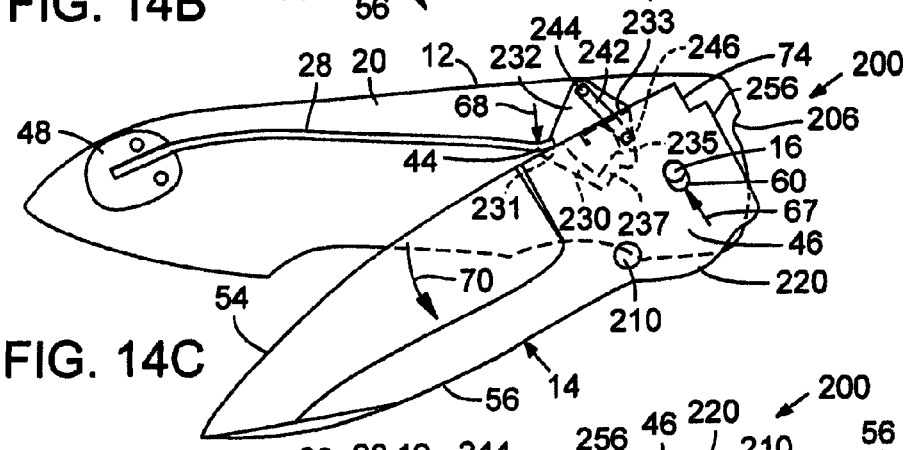
Figure 14D:
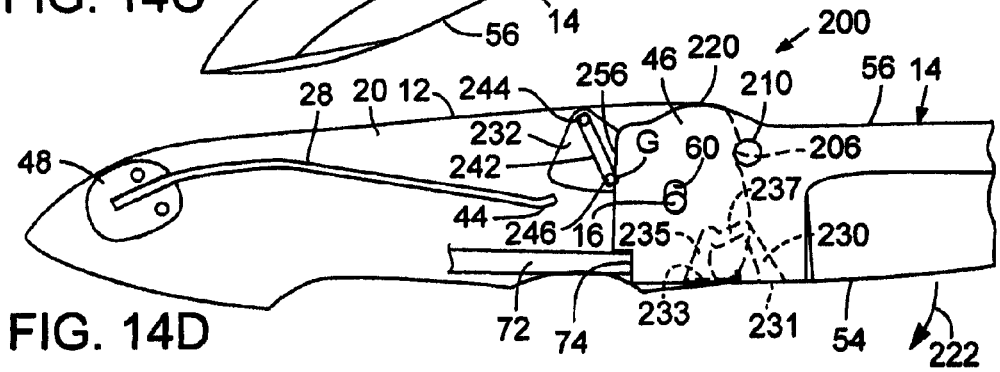

Referring to FIG. 14C, when manual pressure is released from the raised portion 220 of the blade tang, the leaf spring 28 urges the blade to rotate about the pivot mechanism 16 to the open position, as illustrated by arrow 70. When the blade is unlatched, the leaf spring 28 also urges the blade to move transversely a small distance relative to the pivot mechanism in a direction illustrated by arrow 67 opposite the manually applied force. When the blade begins to open, the guide pin 246 moves, relative to the blade, within section 235 of the recessed channel 230 in a direction toward the spring plate 248.

When the blade rotates open further, the guide pin 246 contacts the inner surface of the free end 249 of the spring plate 248. At this point (illustrated by FIG. 15B), the spring plate bends away from the opening 233 of the recessed channel 230 enough to allow the guide pin 246 to move to a position F between the free end 249 of the bent spring plate 248 and an opposing edge 254 of the opening 233 of the channel 230. When the blade rotates open further, the guide pin leaves this position F and moves out of the recessed channel 230. Once the guide pin has passed the spring plate gate, the spring plate closes again and prevents the guide pin from re-entering the recessed channel.

As the blade rotates open further to the open position (FIG. 15C), the wire spring 236 keeps the guide pin 246 pressed against the bottom surface 54 and then the rear surfaces 74, 256 of the blade tang as the guide pin moves, relative to the blade, around to a position G resting against the rear surface 256 of the blade tang. In this position, the contact of the first and second stopping pegs 208, 210 against the first and second concave notches 204, 206, respectively, prevents the blade from rotating open further. When the blade reaches this open position, the blade tang no longer contacts the side of the spring arm 72. This releases the spring arm from tension and allows it to move in a direction illustrated by arrow 76 perpendicular to the blade rotation plane and into a position in line with and abutting the rear surface 74 of the blade tang. When the spring arm 72 is in this position, the blade is held against rotational movement about the pivot mechanism 16 in a closing direction (clockwise in FIG. 14D).

Figure 15D:
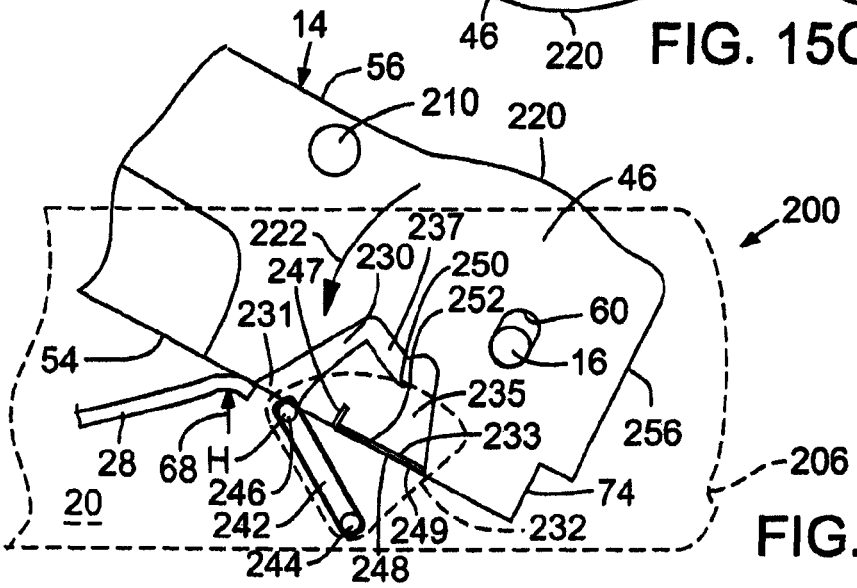

To begin closing the blade, the spring arm 72 is manually moved in the direction of arrow 76 back to the tensed position and held there while the blade is manually rotated in the closing direction (illustrated by arrow 222) until the side surface of the blade tang 46 moves into contact with the spring arm, holding the spring arm in the tensed position. As the blade is manually rotated in the closing direction, the guide pin 246 moves, relative to the blade, back around the rear surfaces of the blade and towards the spring plate 248. Because the spring plate covers the opening 233 of the recessed channel 230 nearest to the rear surface 74, the guide pin is prevented from re-entering the recessed channel at that point. Instead, the guide pin continues to slide across the bottom surface 54 of the blade until the blade has rotated in the closing direction far enough to allow the guide pin to enter the opening 231 of the recessed channel nearest to the sharpened edge 112. As shown in FIG. 15D, when the guide pin has moved along the bottom surface of the blade to a position H where it reaches opening 231 of the recessed channel nearer to the sharpened edge, the bottom surface of the blade tang no longer resists the urging of the wire spring 236 and the wire spring urges the guide pin 246 into the recessed channel.

Figure 15E:
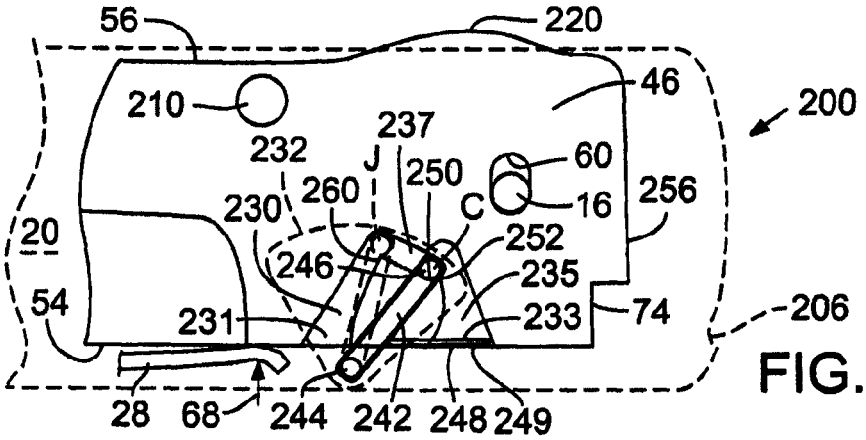

Continued manual closing of the blade causes the guide pin 246 to move up the recessed channel to a position J where the guide pin passes around another edge 260 of the channel (FIG. 15E). Rotation of the blade in the closing direction tenses the leaf spring 28 and causes it to exert a force on the blade in the opening direction (shown by arrow 68). As shown in FIG. 15E, once the guide pin passes channel edge 260, the shape of the channel allows the wire spring 236 to urge the guide pin into a section 237 of the channel where the guide pin can resist the opening force exerted by the leaf spring on the bottom surface of the blade. Once in this section 237 of the channel 230, the wire spring 236 and the leaf spring 28 combine to urge the guide pin back to the stable position C where the guide pin rests in the notch 250 of the channel. At this closed and latched position, all of the internal forces on the blade are in equilibrium and the blade will not open unless an external force is applied to the raised portion 220 of the blade tang. As noted above, the knife can include a safety mechanism that can be moved to a position in the path of the blade where it blocks movement of the blade even if sufficient manual force is applied to unlatch the blade.

In alternative embodiments, the raised portion 220 of the blade can be shaped or fitted with an additional part (e.g., thumb stud 78) to facilitate the operation of the knife as described above in reference to the first embodiment of the folding knife 10.

In addition, the lever 242 and the surfaces 54, 74 of the blade can be configured to prevent the guide pin 246 from entering opening 233 when the blade being closed, and therefore the gate 248 would not be required.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A folding knife comprising:

a handle portion;

a blade pivotably connected to the handle portion and having a bottom surface including a sharpened edge and an upper surface opposite the bottom surface, the blade being pivotable relative to the handle portion between a closed position and an open position wherein the sharpened edge is exposed for use;

a biasing mechanism configured to exert a biasing force against the blade; and a latching mechanism configured to hold the blade in the closed position against the biasing force of the biasing mechanism and wherein manual pressure applied to the blade in a direction moving from the upper surface to the bottom surface is effective to release the blade from being held by the latching mechanism and therefore allow the biasing force to cause the blade to pivot from the closed position toward the open position.

2. The knife of claim 1, wherein the biasing force of the biasing mechanism is sufficient to cause the blade to pivot from the closed position, when the blade is released from being held by the latching mechanism, all the way to the open position, wherein the open and closed positions are the opposite end limits of the path of travel of the blade.

3. The knife of claim 1, wherein the biasing mechanism is a leaf spring having a fixed end portion that is fixed relative to the handle portion and a free end portion that bears against a tang of the blade.

4. The knife of claim 1, wherein when the blade is in its closed position, the biasing mechanism applies the biasing force in a direction that urges the blade from the closed position toward the open position in the absence of the latching mechanism holding the blade in the closed position.

5. The knife of claim 1, wherein when the blade is closed, the biasing force is effective to urge the blade to a closed and latched position wherein the blade is held against opening by the latching mechanism and the application of manual pressure against the blade is effective to move the blade to a closed and unlatched position whereupon the blade pivots toward the open position under the biasing force.

6. The knife of claim 5, wherein the latching mechanism comprises a slot and a pin, the slot being formed in one of the handle portion and the blade and the pin being secured to the other of the handle portion and the blade and extending laterally into the slot, the slot and the pin cooperating to hold the blade in the closed and latched position against the biasing force of the biasing mechanism and to allow the blade to pivot outwardly toward the open position under the biasing force when the blade is moved to the closed and unlatched position when manual pressure is applied to the blade.

7. The knife of claim 6, wherein the slot comprises a first slot portion and a second slot portion, the first slot portion being shaped to receive the pin when the blade is in the closed and latched position and prevent movement of the pin relative to the slot to prevent opening of the blade, the second slot portion being shaped to receive the pin when the blade is moved to the closed and unlatched position and allow movement of the pin within the second slot portion, thereby allowing the blade to move toward the open position under the biasing force.

8. The knife of claim 7, wherein the first slot portion extends along a line that intersects a pivot axis of the blade and the second slot portion extends partially around the pivot axis in an arc.

9. The knife of claim 5, wherein the latching mechanism comprises a slot formed in a side of the blade and a pivoting lever, the lever having a guide pin that extends into the slot, the slot and the pin cooperating to hold the blade in the closed and latched position against the biasing force of the biasing mechanism and to allow the blade to pivot outwardly toward the open position under the biasing force when the blade is moved to the closed and unlatched position when manual pressure is applied to the blade.

10. The knife of claim 1, wherein the blade has a plurality of weight reducing holes angularly spaced along an arc extending partially around a pivot axis of the blade.

11. The knife of claim 10, wherein the plurality of weight reducing holes includes at least first and second holes, the first hole being closer to the sharpened edge of the blade than the second hole and being smaller than the second hole.

12. The knife of claim 1, wherein the handle portion comprises first and second, laterally spaced liners defining a receiving slot for the blade, a screw extending through the first liner into an opening in the second liner, and a spring disposed on the screw between the liners, the screw and the spring cooperating to adjust the spacing between the liners upon adjustment of the screw.

13. The knife of claim 1, further comprising a removable clip having a leg portion slidably and removably received in an opening in the handle portion.

14. The knife of claim 1, wherein the blade is configured to move further into the handle portion when the manual pressure is applied to the blade to release the blade from the latching mechanism.

15. The knife of claim 1, wherein when the blade is closed, the biasing force is effective to urge the blade to a closed and latched position wherein the blade is held against opening by the latching mechanism and the application of manual pressure against the blade is effective to displace a tang of the blade to move along a line intersecting a pivot axis of the blade, wherein displacement of the tang of the blade is effective to move the blade to a closed and unlatched position whereupon the blade can pivot toward the open position under the biasing force.

16. The knife of claim 15, wherein:

the latching mechanism comprises a slot and a pin, the slot being formed in one of the handle portion and the blade and the pin being secured to the other of the handle portion and the blade and extending laterally into the slot, the slot and the pin cooperating to hold the blade in the closed and latched position against the biasing force of the biasing mechanism and to allow the blade to pivot outwardly toward the open position under the biasing force when the blade is moved to the closed and unlatched position when manual pressure is applied to the blade;

the slot comprises a first slot portion and a second slot portion, the first slot portion being shaped to receive the pin when the blade is in the closed and latched position and prevent movement of the pin relative to the slot to prevent opening of the blade, the second slot portion being shaped to receive the pin when the blade is moved to the closed and unlatched position and allow movement of the pin within the second slot portion, thereby allowing the blade to move toward the open position under the biasing force.

17. A folding knife comprising: a handle portion;

a blade pivotably connected to the handle portion and having a bottom surface including a sharpened edge and an upper surface opposite the bottom surface, the blade being moveable from a closed and latched position to a closed and unlatched position, the blade also being pivotable relative to the handle portion from the closed and unlatched position to an open position in a plane defined by the upper surface and bottom surface of the blade, wherein the closed and unlatched position and the open position are at opposite end limits of the path of travel of the blade for pivoting movement of the blade;

biasing means for exerting a biasing force against the blade; and latching means for holding the blade in the closed and latched position against the biasing force of the biasing means, said biasing means causing the blade to pivot toward the open position under the biasing force immediately upon the blade being manually moved from the closed and latched position to the closed and unlatched position;

wherein the blade is configured to be moved from the closed and latched position to the closed and unlatched position in a direction against the biasing force of the biasing means.

18. The folding knife of claim 17, wherein the blade is moveable from the closed and latched position to the closed and unlatched position in a direction of a straight line intersecting a pivot axis of the blade.

19. The folding knife of claim 17, wherein the biasing force of the biasing means is sufficient to cause the blade to pivot from the closed and unlatched position all the way to the open position through about 180 degrees.

20. The folding knife of claim 19, further comprising a blade locking mechanism that automatically engages and resists closing of the blade when the blade is pivoted to the open position.

21. A method of operating a folding knife, the method comprising:

providing the folding knife of claim 17;

when the blade is in the closed and latched position, applying a closing force to the blade in a direction moving from the upper surface to the bottom surface of the blade to displace the blade from the closed and latched position to the closed and unlatched position, thereby releasing the blade from being held by the latching means and allowing the blade to pivot from the closed and unlatched position toward an open position wherein the sharpened edge is exposed for use under the opening force of the biasing means.

22. The knife of claim 17, wherein the blade is moveable from the closed and latched position and to the closed and unlatched position when a closing force is applied to the blade.

23. The folding knife of claim 17, wherein the latching means comprises a slot and a pin, the slot being formed in one of the handle portion and the blade and the pin being secured to the other of the handle portion and the blade and extending laterally into the slot, the slot and the pin cooperating to hold the blade in the closed and latched position against the biasing force of the biasing means and to allow the blade to pivot outwardly toward the open position under the biasing force when the blade is moved to the closed and unlatched position when manual pressure is applied to the blade.

24. A folding knife comprising:

a handle portion;

a blade pivotably connected to the handle portion and having a bottom surface including a sharpened edge and an upper surface opposite the bottom surface, the blade being moveable from a closed and latched position to a closed and unlatched position, the blade also being pivotable relative to the handle portion from the closed and unlatched position to an open position in a plane defined by the upper surface and bottom surface of the blade, wherein the closed and unlatched position and the open position are at opposite end limits of the path of travel of the blade for pivoting movement of the blade;

biasing means for exerting a biasing force against the blade; and latching means for holding the blade in the closed and latched position against the biasing force of the biasing mechanism and for allowing the blade to pivot toward the open position under the biasing force when the blade is manually moved from the closed and latched position to the closed and unlatched position;

wherein the handle portion comprises a back edge and an opening opposite the back edge through which the blade travels when pivoted, and wherein the blade is moveable from the closed and latched position to the closed and unlatched position in a direction toward the back edge of the handle.

25. A folding knife comprising:

a handle portion having a blade receiving space, a back edge, and an opening into the receiving space opposite the back edge;

a blade pivotably connected to the handle portion and having a bottom surface including a sharpened edge and an upper surface opposite the bottom surface, the blade being moveable from a closed and latched position to a closed and unlatched position in a direction into the blade receiving space toward the back edge of the handle portion upon application of manual pressure to the blade, the blade also being pivotable out of the blade receiving space from the closed and unlatched position to an open position wherein the sharpened edge is exposed for use;

a biasing mechanism configured to exert a biasing force against the blade; and a latching mechanism comprising a slot and a pin, the slot being formed in one of the handle portion and the blade and the pin being secured to the other of the handle portion and the blade and extending laterally into the slot, the slot and the pin cooperating to hold the blade in the closed and latched position against the biasing force of the biasing mechanism and, to allow the blade to pivot outwardly from the closed and unlatched position under the biasing force after the blade is moved further into the receiving space to the closed and unlatched position upon application of manual pressure to the blade;

the slot comprising a first slot portion and a second slot portion, the first slot portion being shaped to receive the pin when the blade is in the closed and latched position such that the pin engages a side of the slot and prevents opening of the blade under the biasing force, the second slot portion being shaped to receive the pin when the blade is moved to the closed and unlatched position and allow movement of the pin in the second portion of the slot, thereby allowing the blade to move toward the open position under the biasing force.

* * * * *